US009337540B2

(12) United States Patent
Behdad et al.

(10) Patent No.: US 9,337,540 B2
(45) Date of Patent: May 10, 2016

(54) ULTRA-WIDEBAND, LOW PROFILE ANTENNA

(71) Applicant: Wisconsin Alumni Research Foundation, Madison, WI (US)

(72) Inventors: Nader Behdad, Madison, WI (US); Kasra Ghaemi, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 169 days.

(21) Appl. No.: 14/296,138

(22) Filed: Jun. 4, 2014

(65) Prior Publication Data

US 2015/0357715 A1 Dec. 10, 2015

(51) Int. Cl.
*H01Q 11/12* (2006.01)
*H01Q 7/00* (2006.01)
*H01Q 21/00* (2006.01)

(52) U.S. Cl.
CPC ..... *H01Q 7/00* (2013.01); *H01Q 21/0006* (2013.01)

(58) Field of Classification Search
CPC ..... H01Q 7/00
USPC ..... 343/741, 742, 855, 866, 867
See application file for complete search history.

(56) References Cited

U.S. PATENT DOCUMENTS 2,485,675 A * 10/1949 Larssen ..... G01S 3/10 342/420
3,967,276 A 6/1976 Goubau
4,982,197 A 1/1991 Villaseca et al.
5,146,232 A 9/1992 Nishikawa et al.
5,304,998 A 4/1994 Lopez
5,568,157 A 10/1996 Anderson
5,654,724 A * 8/1997 Chu ..... H01Q 9/38 343/742
5,666,126 A 9/1997 Lange
5,784,032 A 7/1998 Johnston et al.
5,852,421 A 12/1998 Maldonado
6,014,107 A 1/2000 Wiesenfarth
6,054,963 A * 4/2000 Muterspaugh ..... H01Q 1/247 343/741
6,163,302 A 12/2000 Bjorkengren et al.

(Continued)

FOREIGN PATENT DOCUMENTS

WO WO 2005/011050 2/2005

OTHER PUBLICATIONS

Behdad et al., A Very Low-Profile, Omnidirectional, Ultrawideband Antenna, IEEE Antennas and Wireless Propagation Letters, vol. 12, Feb. 22, 2013, pp. 280-283.

(Continued)

*Primary Examiner* — Tho G Phan
(74) *Attorney, Agent, or Firm* — Bell & Manning, LLC

(57) ABSTRACT

An antenna system that includes a ground plane substrate, a first antenna, and a second antenna is provided. The first antenna includes a first loop conductor electrically connected to a feed network and to the ground plane substrate, a second loop conductor electrically connected to the feed network and to the ground plane substrate, and a first conductor mounted to and electrically connected to a first edge of the first loop conductor and to a second edge of the second loop conductor. The second antenna includes a third loop conductor electrically connected to the feed network and to the first conductor, a fourth loop conductor electrically connected to the feed network and to the first conductor, and a second conductor mounted to and electrically connected to a third edge of the third loop conductor and to a fourth edge of the fourth loop conductor.

20 Claims, 12 Drawing Sheets

(56) References Cited

U.S. PATENT DOCUMENTS

| | | | | |
|---|---|---|---|---|
| 6,329,955 | B1 | 12/2001 | McLean et al. | |
| 6,336,036 | B1 | 1/2002 | Hayes | |
| 6,348,897 | B1 | 2/2002 | Alameh et al. | |
| 6,720,929 | B2 | 4/2004 | Nybeck et al. | |
| 6,720,930 | B2 * | 4/2004 | Johnson | H01Q 1/22 340/572.7 |
| 6,828,948 | B2 * | 12/2004 | Volman | H01Q 1/36 343/742 |
| 7,046,199 | B2 | 5/2006 | Montgomery et al. | |
| 7,215,292 | B2 * | 5/2007 | McLean | H01Q 7/00 343/725 |
| 7,268,741 | B2 | 9/2007 | Sarabandi et al. | |
| 7,760,151 | B2 * | 7/2010 | Poilasne | H01Q 1/241 343/742 |
| 7,764,242 | B2 | 7/2010 | Milyakh | |
| 8,184,060 | B2 | 5/2012 | Du et al. | |
| 8,228,251 | B1 | 7/2012 | Behdad et al. | |
| 8,237,617 | B1 | 8/2012 | Johnson et al. | |
| 2004/0090372 | A1 | 5/2004 | Nallo et al. | |
| 2006/0012535 | A1 | 1/2006 | McLean | |
| 2006/0055619 | A1 | 3/2006 | Sarabandi et al. | |
| 2007/0279296 | A1 | 12/2007 | Sarabandi et al. | |
| 2009/0153303 | A1 | 6/2009 | Forster | |
| 2014/0347243 | A1 | 11/2014 | Abadi et al. | |

OTHER PUBLICATIONS

International Search Report and Written Opinion issued in PCT/US2011/038560, Apr. 26, 2012.

* cited by examiner

ULTRA-WIDEBAND, LOW PROFILE ANTENNA

REFERENCE TO GOVERNMENT RIGHTS

This invention was made with government support under N00014-11-1-0618 awarded by the US Navy/ONR. The government has certain rights in the invention.

BACKGROUND

In some applications, ultra-wideband antennas are needed to operate at very low frequencies, for example, at or below the ultra high frequency band. At such frequencies, the electromagnetic wavelength is very large. Consequently, any antenna that is used at these frequencies is physically very large. This physically large dimension, i.e. 30-40 feet, may result in a very high antenna that can be easily seen.

An "electrically-small" antenna refers to an antenna or antenna element with relatively small geometrical dimensions compared to the wavelength of the electromagnetic fields the antenna radiates. Electrically-small antenna elements may be used in low frequency applications to overcome issues associated with the physical size of the antenna determined based on the wavelength.

SUMMARY

In an illustrative embodiment, an antenna system is provided. The antenna system includes, but is not limited to, a ground plane substrate, a first antenna, and a second antenna. The first antenna includes, but is not limited to, a first loop conductor, a second loop conductor, and a first conductor. The first loop conductor is electrically connected at a first point to a feed network and at a second point to the ground plane substrate. The second loop conductor is electrically connected at a third point to the feed network and at a fourth point to the ground plane substrate. The first conductor is mounted to and electrically connected to a first edge of the first loop conductor between the first point and the second point and to a second edge of the second loop conductor between the third point and the fourth point.

The second antenna includes, but is not limited to, a third loop conductor, a fourth loop conductor, and a second conductor. The third loop conductor is electrically connected at a fifth point to the feed network and at a sixth point to the first conductor. The fourth loop conductor is electrically connected at a seventh point to the feed network and at an eighth point to the first conductor. The second conductor is mounted to and electrically connected to a third edge of the third loop conductor between the fifth point and the sixth point and to a fourth edge of the fourth loop conductor between the seventh point and the eighth point.

Other principal features of the current disclosure will become apparent to those skilled in the art upon review of the following drawings, the detailed description, and the appended claims.

BRIEF DESCRIPTION OF THE DRAWINGS

Illustrative embodiments will be described referring to the accompanying drawings, wherein like numerals denote like elements.

DETAILED DESCRIPTION

Figure 1:
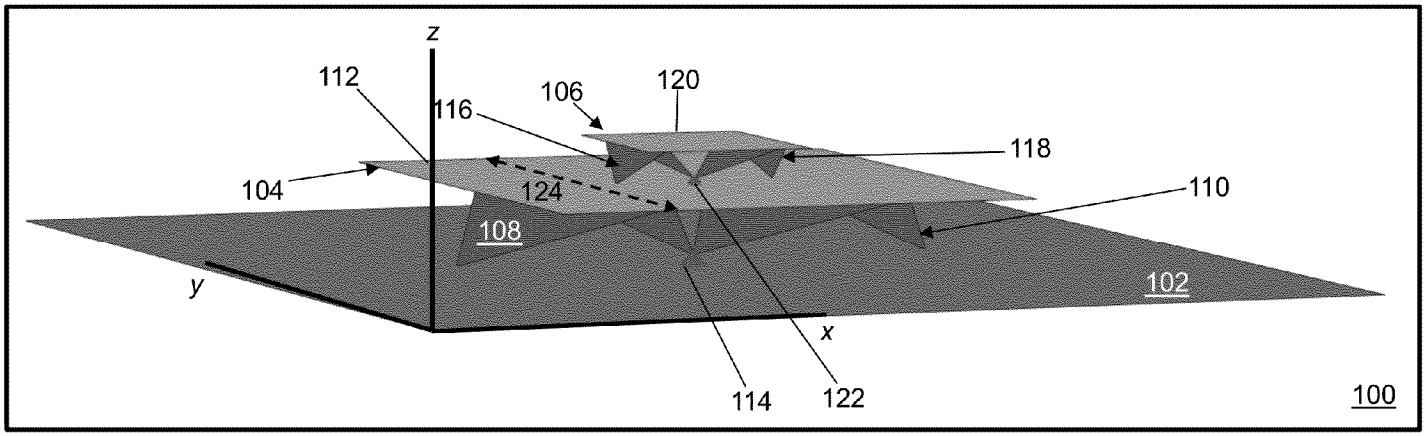
FIG. 1 shows a perspective view of an antenna system in accordance with an illustrative embodiment.

With reference to FIG. 1, a top perspective view of an antenna system 100 is shown in accordance with an illustrative embodiment. Antenna system 100 may include a ground plane substrate 102, a first antenna 104, and a second antenna 106. Ground plane substrate 102 is electrically grounded and may be formed of any material suitable for forming an electrical ground for antenna system 100. For example, ground plane substrate 102 may be formed of a metal sheet alone or with a dielectric or magnetic material or a magneto-dielectric material on a top surface of the metal sheet.

First antenna 104 may include a first loop conductor 108, a second loop conductor 110, and a first conductor 112. First loop conductor 108 is electrically connected to a first feed connector 114 and to ground plane substrate 102. First conductor 112 is mounted to and electrically connected to a first edge 206 (shown with reference to FIG. 2) of first loop conductor 108 between first feed connector 114 and ground plane substrate 102. Second loop conductor 110 is electrically connected to first feed connector 114 and to ground plane substrate 102. First conductor 112 is mounted to and electrically connected to a second edge 220 (shown with reference to FIG.

2) of second loop conductor 110 between first feed connector 114 and ground plane substrate 102. First loop conductor 108 is mounted to ground plane substrate 102 as a mirror image of second loop conductor 110. As used herein, a loop conductor references a conductor that is electrically connected to receive an electrical signal at a feed point and to ground.

Second antenna may include a third loop conductor 116, a fourth loop conductor 118, and a second conductor 120. Third loop conductor 116 is electrically connected to a second feed connector 122 and to first conductor 112. Second conductor 120 is mounted to and electrically connected to a third edge 306 (shown with reference to FIG. 3) of third loop conductor 116 between second feed connector 122 and first conductor 112. Fourth loop conductor 118 is electrically connected to first feed connector 114 and to first conductor 112. Second conductor 120 is mounted to and electrically connected to a fourth edge 320 (shown with reference to FIG. 3) of fourth loop conductor 118 between second feed connector 122 and first conductor 112. Third loop conductor 116 is mounted to first conductor 112 as a mirror image of fourth loop conductor 118.

As used herein, the term "mount" includes join, unite, connect, couple, associate, insert, hang, hold, affix, attach, fasten, bind, paste, secure, bolt, screw, rivet, solder, weld, glue, form over, form in, layer, mold, thermoform, rest on, rest against, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element). Elements referenced as mounted to each other herein may further be integrally formed together, for example, using a molding or thermoforming process as understood by a person of skill in the art. As a result, elements described herein as being mounted to each other need not be discrete structural elements. The elements may be mounted permanently, removably, or releasably unless specified otherwise.

Figure 2:
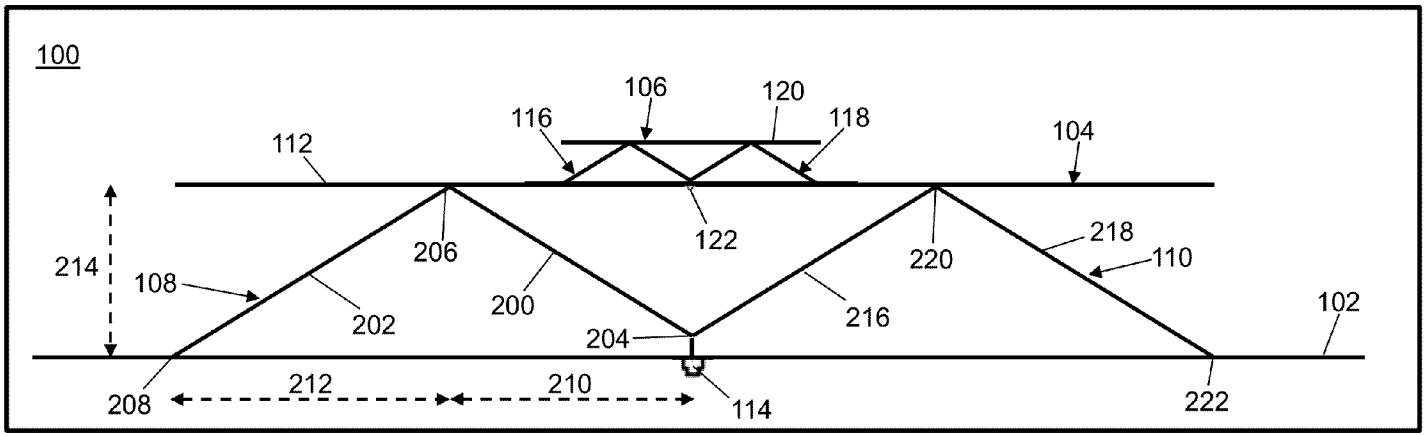
FIG. 2 shows a side view of the antenna system of FIG. 1 in accordance with an illustrative embodiment.
Figure 5:
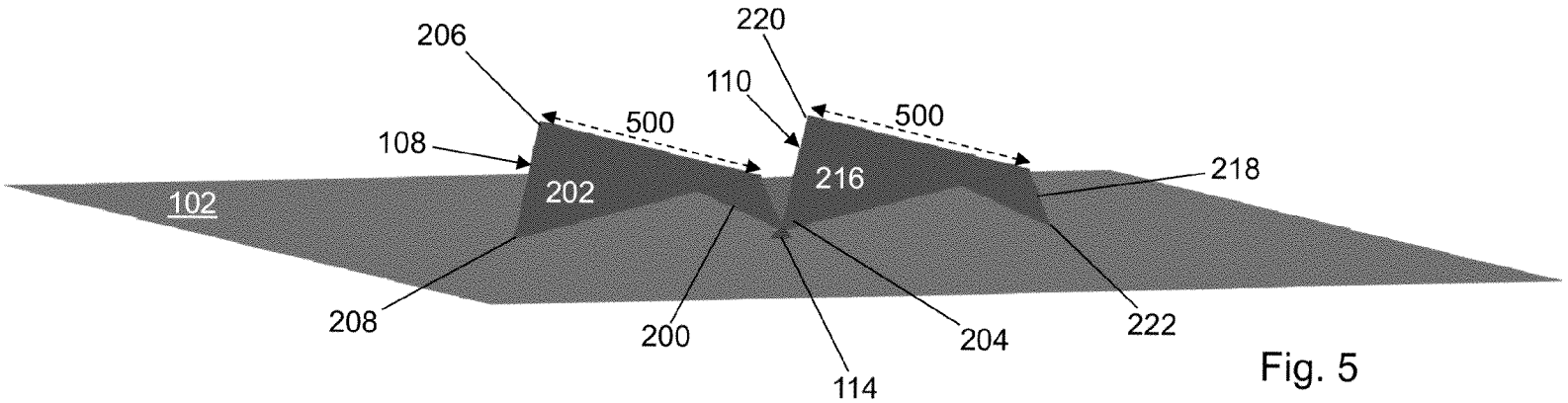
FIG. 5 shows a perspective view of a pair of loop conductors of a bottom antenna of the antenna system of FIG. 1 in accordance with an illustrative embodiment.

With reference to FIG. 2, a side view of antenna system 100 is shown in accordance with an illustrative embodiment. With reference to FIG. 5, a perspective view of first loop conductor 108 and second loop conductor 110 is shown in accordance with an illustrative embodiment. Referring to FIGS. 2 and 5, first loop conductor 108 and second loop conductor 110 are fed in parallel at a common feeding point, a first feed point 204, that is electrically connected to first feed connector 114. First loop conductor 108 may include a first loop inner conductor 200 and a first loop outer conductor 202.

In the illustrative embodiment of FIGS. 2 and 5, first loop conductor 108 has a quadrilateral shape, such as a kite or rhombus shape, when projected into a plane defined by ground plane substrate 102. First loop inner conductor 200 forms a first isosceles triangle such that adjacent sides that extend from first feed point 204 are of equal length. First loop inner conductor 200 is electrically connected at first feed point 204 to first feed connector 114 that is connected to a feed network 900 (shown with reference to FIG. 9). First loop inner conductor 200 is electrically connected along first edge 206, an edge that is opposite first feed point 204, to first conductor 112.

First loop outer conductor 202 is electrically connected at a first short circuit connection 208 to ground plane substrate 102. First loop outer conductor 202 forms a second isosceles triangle such that adjacent sides that extend from first short circuit connection 208 are of equal length. First loop outer conductor 202 is electrically connected along first edge 206, an edge that is opposite first short circuit connection 208, to first conductor 112. First loop conductor 108 may be formed by bending a continuous sheet of material along a diagonal that forms first edge 206 between adjacent sides of the first and second isosceles triangles.

First loop inner conductor 200 has a first length 210 when projected into the plane defined by ground plane substrate 102. First loop outer conductor 202 has a second length 212 when projected into the plane defined by ground plane substrate 102. First length 210 and second length 212 may be equal indicating that first loop inner conductor 200 and first loop outer conductor 202 have the same size and that first loop conductor 108 forms a rhombus, instead of a kite, when projected into the plane defined by ground plane substrate 102. First edge 206 extends above ground plane substrate 102 at a first height 214.

Second loop conductor 110 may include a second loop inner conductor 216 and a second loop outer conductor 218. In the illustrative embodiment of FIGS. 2 and 5, second loop conductor 110 has a quadrilateral shape, such as a kite or rhombus shape, when projected into the plane defined by ground plane substrate 102. Second loop inner conductor 216 forms a third isosceles triangle such that adjacent sides that extend from first feed point 204 are of equal length. Second loop inner conductor 216 is electrically connected at first feed point 204 to first feed connector 114 that is connected to feed network 900. Second loop inner conductor 216 is electrically connected along second edge 220, an edge that is opposite first feed point 204, to first conductor 112.

Second loop outer conductor 218 is electrically connected at a second short circuit connection 222 to ground plane substrate 102. Second loop outer conductor 218 forms a fourth isosceles triangle such that adjacent sides that extend from second short circuit connection 222 are of equal length. Second loop outer conductor 218 is electrically connected along second edge 220, an edge that is opposite second short circuit connection 222, to first conductor 112. Second loop conductor 110 may be formed by bending a continuous sheet of material along a diagonal that forms second edge 220 between adjacent sides of the third and fourth isosceles triangles.

In the illustrative embodiment, first conductor 112 has a first conductor width 124 (shown with reference to FIG. 1). In the illustrative embodiment, first edge 206 and second edge 220 have a first edge width 500. In the illustrative embodiment, first conductor width 124 is greater than first edge width 500. First conductor 112 has a width of approximately twice first length 210 plus second length 212 to cover first loop conductor 108 and second loop conductor 110.

In the illustrative embodiment, first antenna 104 includes two loops, first loop conductor 108 and second loop conductor 110. In alternative embodiments, first antenna 104 may include one or more additional loops. In the illustrative embodiment, first loop conductor 108 and second loop conductor 110 are connected to ground plane substrate 102 at a single point, first short circuit connection 208 and second short circuit connection 222, respectively. In alternative embodiments, first loop conductor 108 and second loop conductor 110 may be connected to ground plane substrate 102 at a plurality of points to form a plurality of short circuit connections. The short circuit connection point between the loop conductors and ground plane substrate 102 may vary in size and shape.

Figure 3:
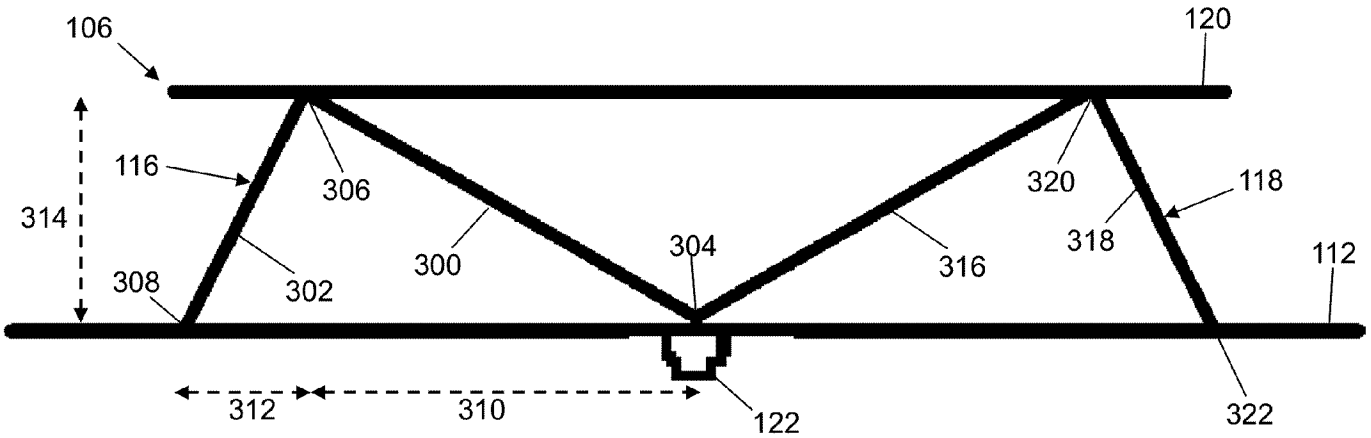
FIG. 3 shows a side view of a top antenna of the antenna system of FIG. 1 in accordance with an illustrative embodiment.

With reference to FIG. 3, a side view of second antenna 106 mounted on first conductor 112 is shown in accordance with an illustrative embodiment. Third loop conductor 116 and fourth loop conductor 118 are fed in parallel at a common feeding point, a second feed point 304, that is electrically connected to second feed connector 122. Third loop conductor 116 may include a third loop inner conductor 300 and a third loop outer conductor 302. In the illustrative embodiment of FIG. 3, third loop conductor 116 has a quadrilateral shape, such as a kite or rhombus shape, when projected into the plane defined by ground plane substrate 102. Third loop inner conductor 300 forms a fifth isosceles triangle such that adjacent sides that extend from second feed point 304 are of equal length. Third loop inner conductor 300 is electrically connected at second feed point 304 to second feed connector 122 that is connected to feed network 900. Third loop inner conductor 300 is electrically connected along third edge 306, an edge that is opposite second feed point 304, to second conductor 120.

Third loop outer conductor 302 is electrically connected at a third short circuit connection 308 to first conductor 112. Third loop outer conductor 302 forms a sixth isosceles triangle such that adjacent sides that extend from third short circuit connection 308 are of equal length. Third loop outer conductor 302 is electrically connected along third edge 306, an edge that is opposite third short circuit connection 308, to second conductor 120. Third loop conductor 116 may be formed by bending a continuous sheet of material along a diagonal that forms third edge 306 between adjacent sides of the fifth and sixth isosceles triangles.

Third loop inner conductor 300 has a third length 310 when projected into the plane defined by ground plane substrate 102. Third loop outer conductor 302 has a fourth length 312 when projected into the plane defined by ground plane substrate 102. Third length 310 and fourth length 312 may be equal indicating that third loop inner conductor 300 and third loop outer conductor 302 have the same size and that third loop conductor 116 forms a rhombus, instead of a kite, when projected into the plane defined by ground plane substrate 102. In the illustrative embodiment of FIG. 3, third length 310 is greater than fourth length 312. Third edge 306 extends above first conductor 112 at a second height 314.

Fourth loop conductor 118 may include a fourth loop inner conductor 316 and a fourth loop outer conductor 318. In the illustrative embodiment of FIG. 3, fourth loop conductor 118 has a quadrilateral shape, such as a kite or rhombus shape, when projected into the plane defined by ground plane substrate 102. Fourth loop inner conductor 316 forms a seventh isosceles triangle such that adjacent sides that extend from second feed point 304 are of equal length. Fourth loop inner conductor 316 is electrically connected at second feed point 304 to second feed connector 122 that is connected to feed network 900. Fourth loop inner conductor 316 is electrically connected along fourth edge 320, an edge that is opposite second feed point 304, to second conductor 120.

Fourth loop outer conductor 318 is electrically connected at a fourth short circuit connection 322 to first conductor 112. Fourth loop outer conductor 318 forms an eighth isosceles triangle such that adjacent sides that extend from fourth short circuit connection 322 are of equal length. Fourth loop outer conductor 318 is electrically connected along fourth edge 320, an edge that is opposite fourth short circuit connection 322, to second conductor 120. Fourth loop conductor 118 may be formed by bending a continuous sheet of material along a diagonal that forms fourth edge 320 between adjacent sides of the seventh and eighth isosceles triangles.

Figure 4:
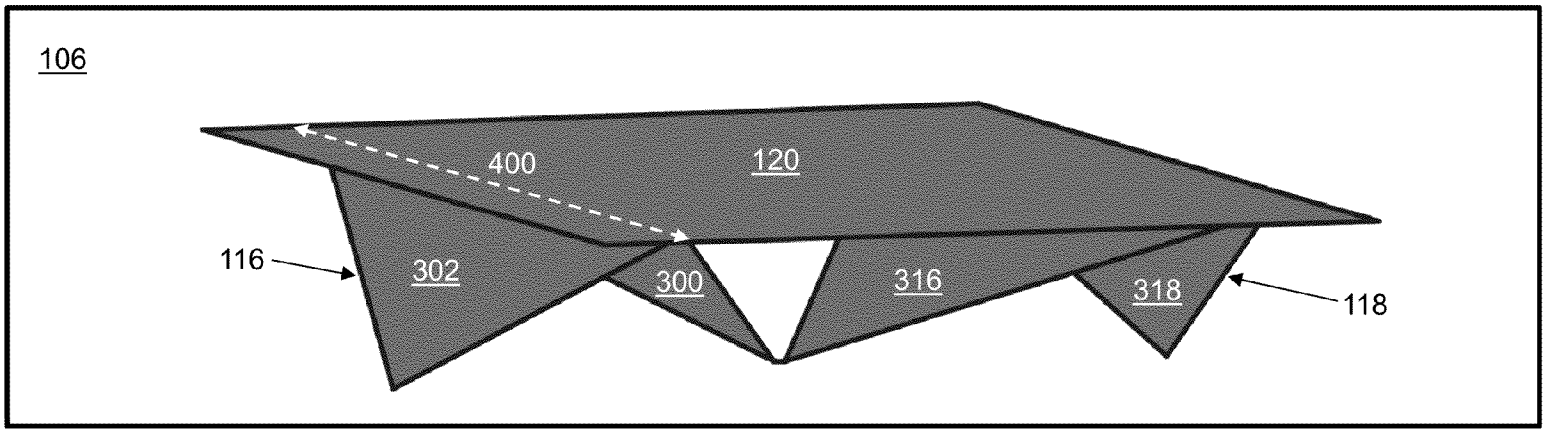
FIG. 4 shows a perspective view of the top antenna of FIG. 3 in accordance with an illustrative embodiment.

With reference to FIG. 4, a perspective view of second antenna 106 is shown in accordance with an illustrative embodiment. In the illustrative embodiment, second conductor 120 has a second conductor width 400. First conductor 112 and second conductor 120 are generally flat and planar and oriented approximately parallel to the plane defined by ground plane substrate 102. Third edge 306 and fourth edge 320 of third loop conductor 116 and of fourth loop conductor 118, respectively, have a second edge width (not shown) that is smaller than second conductor width 400 in an illustrative embodiment.

In the illustrative embodiment, second antenna 106 includes two loops, third loop conductor 116 and fourth loop conductor 118. In alternative embodiments, second antenna 106 may include one or more additional loops. In the illustrative embodiment, third loop conductor 116 and fourth loop conductor 118 are connected to ground plane substrate 102 at a single point, third short circuit connection 308 and fourth short circuit connection 322, respectively. In alternative embodiments, third loop conductor 116 and fourth loop conductor 118 may be connected to first conductor 112 at a plurality of points to form a plurality of short circuit connections.

First antenna 104 and second antenna 106 may be formed of any conducting material(s) suitable for forming a radiator of antenna system 100. For example, first antenna 104 and second antenna 106 may be formed of copper or brass sheets among many other options as understood by a person of skill in the art. First loop conductor 108, second loop conductor 110, first conductor 112, third loop conductor 116, fourth loop conductor 118, and second conductor 120 may be formed of the same or different materials.

In an illustrative embodiment, second antenna 106 is a smaller scaled version of first antenna 104. For example, second antenna 106 may be designed such that second antenna 106 has a lowest frequency of operation that approximately coincides with a highest frequency of operation of first antenna 104. The highest frequency of operation of first antenna 104 may be determined by the maximum frequency at which a radiation pattern of first antenna 104 remains acceptable for the desired use of antenna system 100. For example, the maximum frequency at which the radiation pattern of first antenna 104 remains approximately omni-directional may define the highest frequency of operation of first antenna 104.

The lowest frequency of operation, $f_{low}$, for each antenna can be approximated based on the dimensions of first antenna 104 and/or of second antenna 106 using $$f_{low} = \frac{l_1}{8\sqrt{l_1^2 + h^2}\int_0^{l_1} \mu_0\varepsilon_0\left(\frac{xf + l_1 W}{x(f - W) + Wl_1}\right)dx}$$

where $l_1$ is first length 210 or third length 310, h is first height 214 or second height 314, $\mu_0$ is the magnetic permeability of free space, $\in_0$ is the permittivity of free space, x is an arbitrary variable for integration, f is first edge width 500 or the second edge width of third loop conductor 116 and of fourth loop conductor 118, and W is first conductor width 124 or second conductor width 400.

In the illustrative embodiment of FIGS. 1-4, first conductor 112 and second conductor 120 are generally flat and have a square or rectangular shape. In alternative embodiments, first conductor 112 and second conductor 120 may form other polygonal, circular, or elliptical shapes and may not be flat. In the illustrative embodiment of FIGS. 1-5, first loop conductor 108, second loop conductor 110, third loop conductor 116, and fourth loop conductor 118 form a kite or rhombus shape when projected into ground plane substrate 102. In alternative embodiments, first loop conductor 108, second loop conductor 110, third loop conductor 116, and fourth loop conductor 118 may form other polygonal, circular, or elliptical shapes when projected into ground plane substrate 102.

For illustration, first feed connector 114 of first antenna 104 may be a subminiature version A (SMA) connector mounted at a center of ground plane substrate 102. Second antenna 106 may be fed with a semi-rigid coaxial cable that passes through a hole drilled in ground plane substrate 102. The hole may be positioned off center with respect to first feed connector 114 to avoid first feed connector 114. Above ground plane substrate 102, an S-shaped bend may be formed in the semi-rigid coaxial cable to feed second antenna 106 at a center of first conductor 112. An outer conductor of the semi-rigid coaxial cable may be connected to first conductor 112 of first antenna 104. A center conductor of the semi-rigid coaxial cable may be connected to second feed connector 122. An outer shield of the semi-rigid coaxial cable may be electrically connected to ground plane substrate 102 where the semi-rigid coaxial cable passes through ground plane substrate 102 to ensure that any current induced on the outer shield by first antenna 104 is shorted to ground and does not flow along the semi-rigid coaxial cable to excite second antenna 106.

Figure 6:
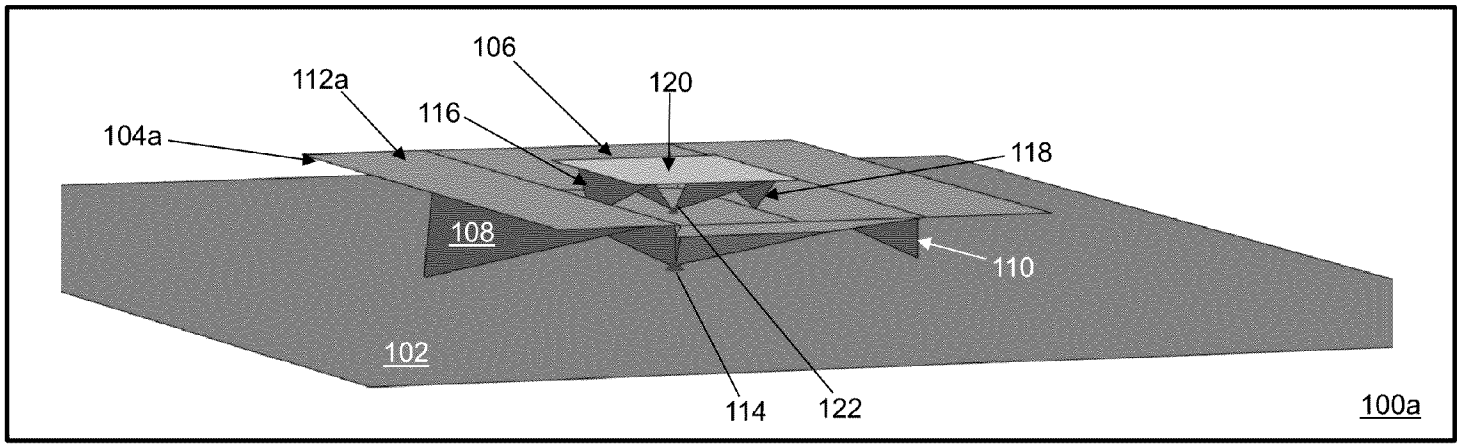
FIG. 6 shows a perspective view of a second antenna system in accordance with an illustrative embodiment.

With reference to FIG. 6, a top perspective view of a second antenna system 100*a* is shown in accordance with an illustrative embodiment. Second antenna system 100*a* may include ground plane substrate 102, a third antenna 104*a*, and second antenna 106. Third antenna 104*a* may include first loop conductor 108, second loop conductor 110, and a third conductor 112*a*. Third conductor 112*a* is mounted to and electrically connected to first edge 206 of first loop conductor 108 between first feed connector 114 and ground plane substrate 102. Third conductor 112*a* is mounted to and electrically connected to second edge 220 of second loop conductor 110 between first feed connector 114 and ground plane substrate 102.

Figure 7:
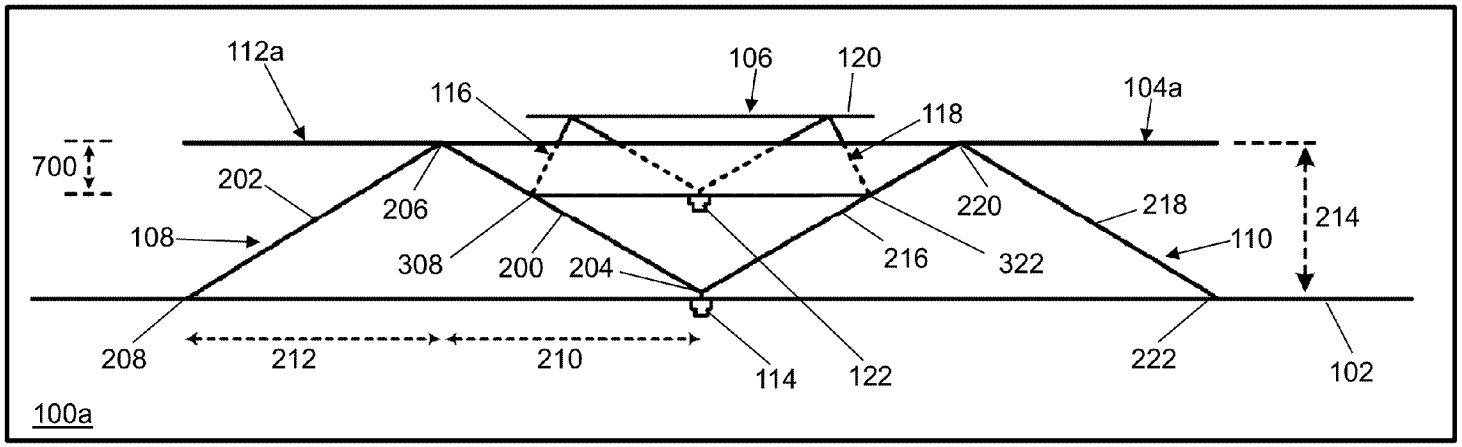
FIG. 7 shows a side view of the second antenna system of FIG. 6 in accordance with an illustrative embodiment.

Third conductor 112*a* forms a recess formed between first loop inner conductor 200 and second loop inner conductor 216 within which second antenna 106 is mounted to reduce an overall height of second antenna system 100*a* relative to antenna system 100. With reference to FIG. 7, a side view of second antenna system 100*a* is shown in accordance with an illustrative embodiment. Second antenna system 100*a* is reduced in overall height relative to an overall height of antenna system 100. The overall height of antenna system 100 is equal to first height 214 plus second height 314. The overall height of second antenna system 100*a* is reduced relative to antenna system 100 by a recess depth 700. As a result, second antenna 106 extends above first edge 206 a distance of second height 314 minus recess depth 700. Due to this, a minimum distance between third short circuit connection 308 and ground plane substrate 102 is less than a minimum distance between first edge 206 and ground plane substrate 102.

Figure 8:
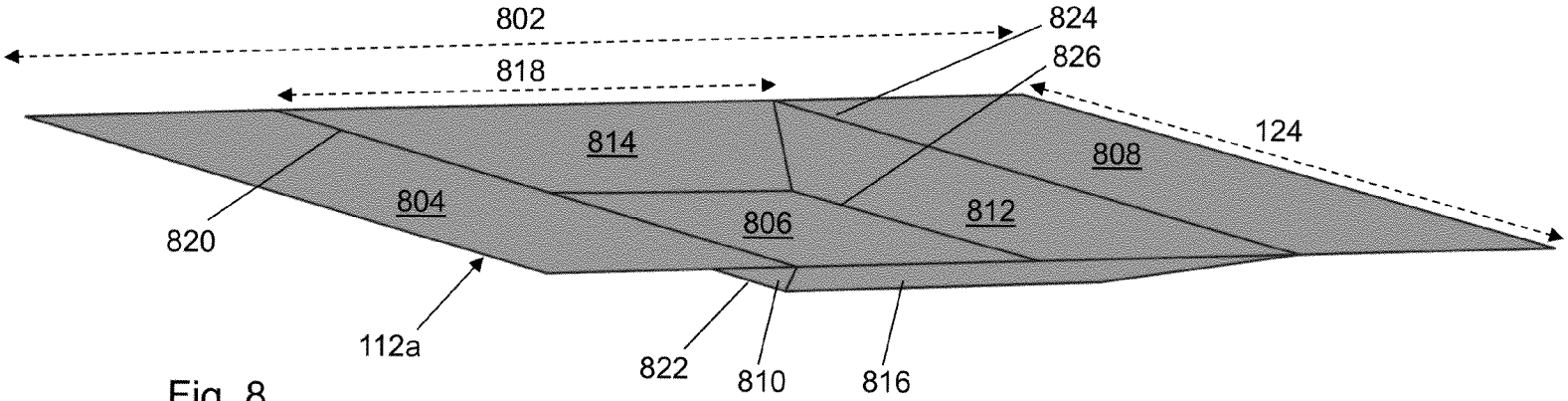
FIG. 8 shows a perspective view of a conductor of a bottom antenna of the second antenna system of FIG. 6 in accordance with an illustrative embodiment.

With reference to FIG. 8, a perspective view of third conductor 112*a* is shown in accordance with an illustrative embodiment though other conductor structures may be used. Third conductor 112*a* may include a first plate 804, a second plate 806, and a third plate 808 that are generally planar and flat and extend approximately parallel to ground plane substrate 102. First plate 804, second plate 806, and third plate 808 each have a width equal to first conductor width 124. Third conductor 112*a* has a total length 802. The cavity formed between first edge 206 and second edge 220 has a cavity length 818 within which second antenna 106 is mounted.

A right edge 820 of first plate 804 mounts to first edge 206. A left edge 824 of third plate 808 mounts to second edge 220. A first sloped wall 810 extends from right edge 820 of first plate 804 to a left edge 822 of second plate 806. A second sloped wall 812 extends from left edge 824 of third plate 808 to a right edge 826 of second plate 806. First sloped wall 810 mounts to and extends parallel to first loop inner conductor 200. Second sloped wall 812 mounts to and extends parallel to second loop inner conductor 216. A third sloped wall 814 extends upward from a top edge of second plate 806. A fourth sloped wall 816 extends upward from a bottom edge of second plate 806. First sloped wall 810, second sloped wall 812, third sloped wall 814, and fourth sloped wall 816 form the recess within which second antenna 106 is mounted. Third short circuit connection 308 and fourth short circuit connection 322 are mounted to second plate 806 of third conductor 112*a*. Second feed connector 122 is mounted to second plate 806 of third conductor 112*a*.

Third antenna 104*a* may be formed of any conducting material(s) suitable for forming a radiator of second antenna system 100*a*. For example, third antenna 104*a* may be formed of copper or brass sheets among many other options as understood by a person of skill in the art. Third conductor 112*a* may be formed of the same or different materials.

Figure 9:
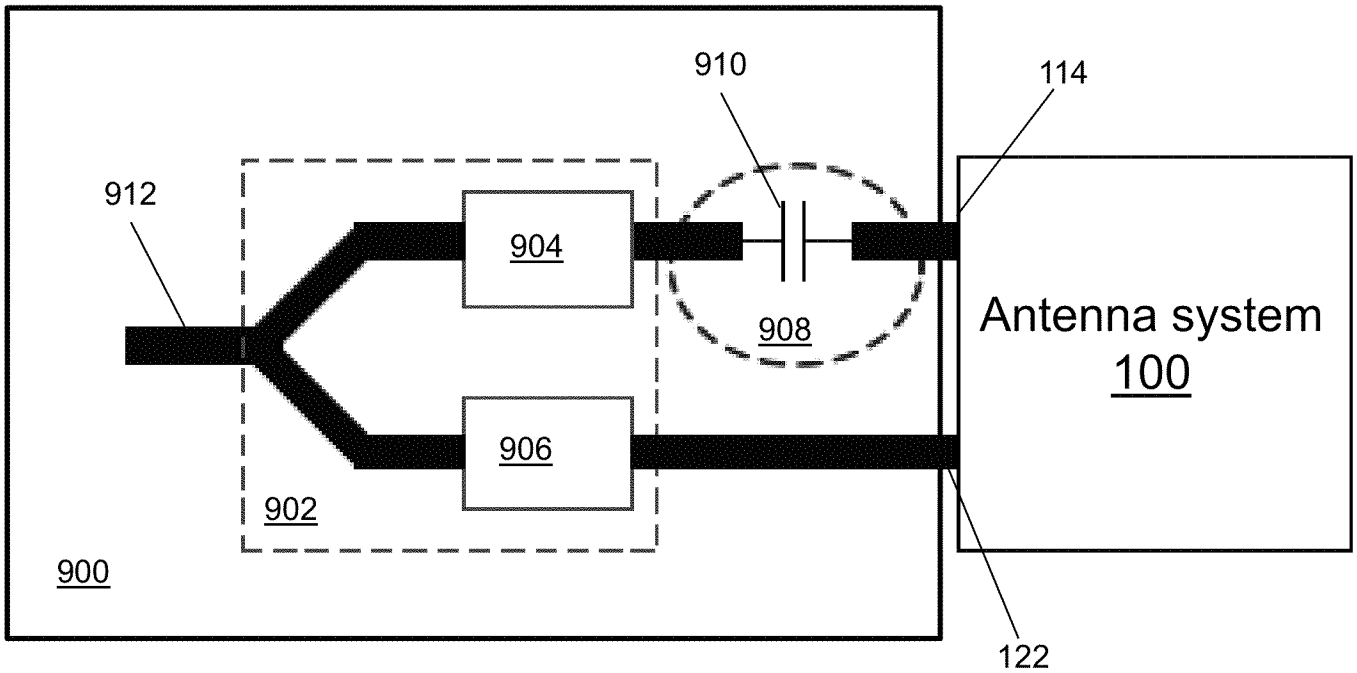
FIG. 9 shows a block diagram of a feed network of the antenna systems of FIGS. 1 and 6 in accordance with an illustrative embodiment.

With reference to FIG. 9, a block diagram of feed network 900 is shown in accordance with an illustrative embodiment. To work as a single, ultra-wideband radiator, antenna system 100 or second antenna system 100*a* uses a frequency-dependent feed network that feeds the appropriate antenna based on a transmission frequency of an input signal input on a feed line 912. Feed network 900 may include a diplexer 902 configured to provide a first signal having a transmission frequency below approximately a first frequency to first feed connector 114 of first antenna 104 and to provide a second signal having a transmission frequency approximately above the first frequency to second feed connector 122 of second antenna 106. Second antenna 106 is a smaller scaled version of first antenna 104 based on the first frequency. In an illustrative embodiment, diplexer 902 may include a low pass filter 904 and a high pass filter 906 designed based on the first frequency as understood by a person of skill in the art. Feed network 900 may further include an impedance matching circuit 908 electrically connected to diplexer 902.

A sharp out-of-band rejection for diplexer 902 may be provided using high-order filters (i.e., $6^{th}$ order) for low pass filter 904 and for high pass filter 906 to ensure that each antenna is excited in the desired frequency band of operation. Having a sharp out-of-band rejection is particularly important in the case of low pass filter 904 used to feed first antenna 104/third antenna 104*a* because first antenna 104/third antenna 104*a* can operate at higher frequency bands and its excitation may result in deterioration of the radiation patterns of antenna system 100 or second antenna system 100*a*, respectively. Second feed connector 122 may be a coaxial cable connector with coaxial cable passing through ground plane substrate 102 of first conductor 112 or third conductor 112*a*. Since the coaxial cable passes through the near-field of first antenna 104/third antenna 104*a*, it may slightly impact the impedance matching of first antenna 104/third antenna 104*a*. As a result, in the illustrative embodiment, impedance matching circuit 908 includes a series connected capacitor 910 connected between low pass filter 904 and first feed connector 114 of first antenna 104/third antenna 104*a*. Series connected capacitor 910 is selected to improve an overall voltage standing wave ratio (VSWR) of antenna system 100 or of second antenna system 100*a*.

For illustration, first antenna 104 (or third antenna 104*a*) may lose its omnidirectionality at ~2 gigahertz (GHz). Second antenna 106 may be designed to start radiating efficiently at ~2 GHz. Diplexer 902 then is designed to have a transition frequency for low pass filter 904 and high pass filter 906 at ~2 GHz.

Figures 10, 11:
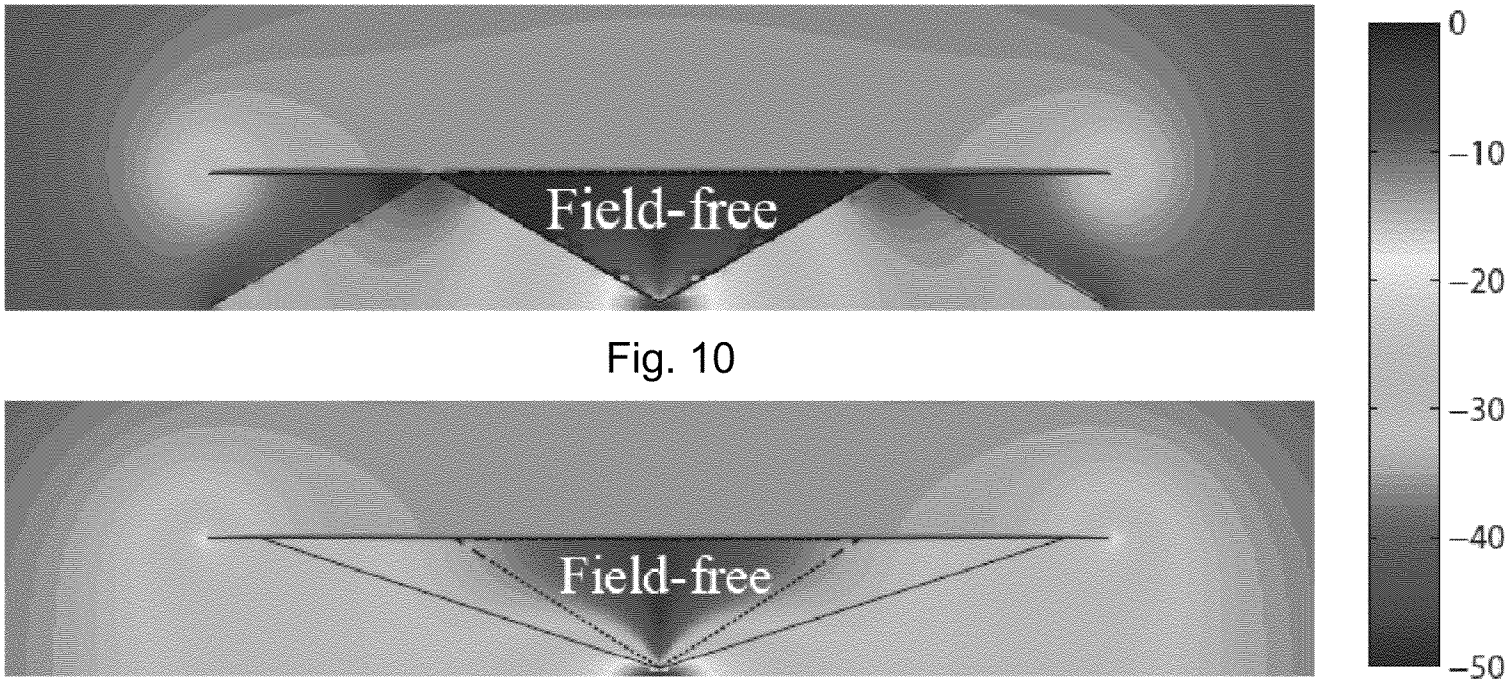
FIG. 10 is a graph showing an electric field distribution in an x-z plane of a bottom antenna of the antenna system of FIG. 1.
FIG. 11 is a graph showing an electric field distribution in an y-z plane of a bottom antenna of the antenna system of FIG. 1.
Figures 12, 13:
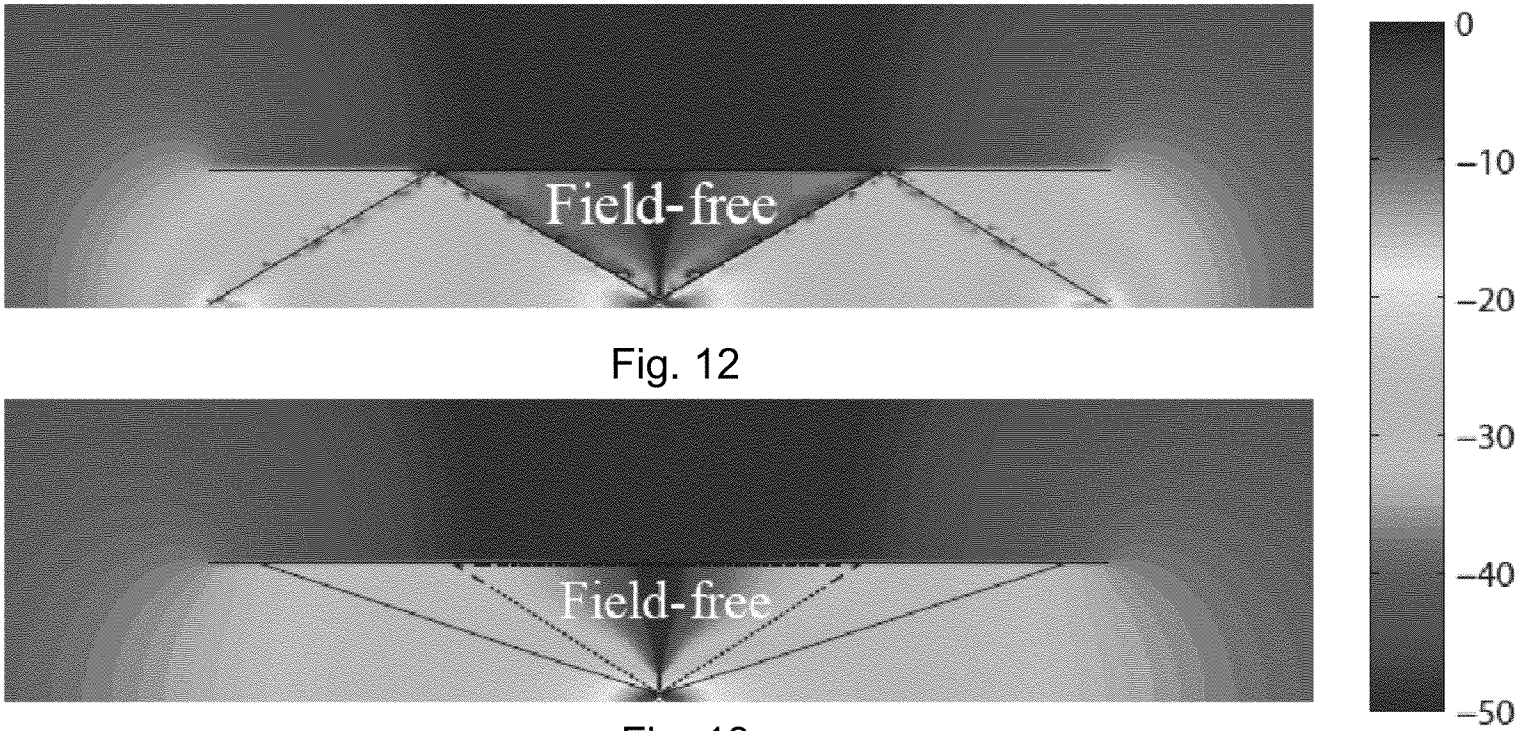
FIG. 12 is a graph showing a magnetic field distribution in an x-z plane of a bottom antenna of the antenna system of FIG. 1.
FIG. 13 is a graph showing a magnetic field distribution in an y-z plane of a bottom antenna of the antenna system of FIG. 1.

With reference to FIG. 10, a normalized electric field distribution from first antenna 104 in an x-z (see axes in FIG. 1) plane at 1.0 GHz is shown. With reference to FIG. 11, a normalized electric field distribution from first antenna 104 in a y-z plane at 1.0 GHz is shown. With reference to FIG. 12, a normalized magnetic field distribution from first antenna 104 in the x-z plane at 1.0 GHz is shown. With reference to FIG. 13, a normalized magnetic field distribution from first antenna 104 in the y-z plane at 1.0 GHz is shown. The intensities of the electric and magnetic fields in the central region of first antenna 104 (marked 'Field free') are significantly smaller (<~−25 dB) than the field intensities in the other regions. Thus, second antenna 106 is mounted in a relatively field free (<~−25 dB) area of first antenna 104/third antenna 104*a*.

To examine the impact of recess depth 700 on the performance of second antenna system 100*a*, a prototype was simulated using the three-dimensional electromagnetic simulation CST Microwave Studio® developed by CST Computer Simulation Technology AG. The dimensions of first antenna 104/third antenna 104*a* were 12.1 centimeters (cm)×12.1 cm×1.8 cm and of second antenna 106 were 4 cm×4 cm×0.9 cm. First length 210 and second length 212 were 30.2 cm. Third length 310 was 15.1 cm, and fourth length 312 was 4.5 cm. First edge width 500 of first loop conductor 108 and of second loop conductor 110 was 109 cm. The second edge width of third loop conductor 116 and of fourth loop conductor 118 was 36.3 cm. These dimensions were chosen so that first antenna 104/third antenna 104*a* and second antenna 106 have lowest frequencies of operation of 0.6 GHz and 2 GHz, respectively. In the simulations, each antenna was fed with a lumped port at its feed location.

Figure 14:
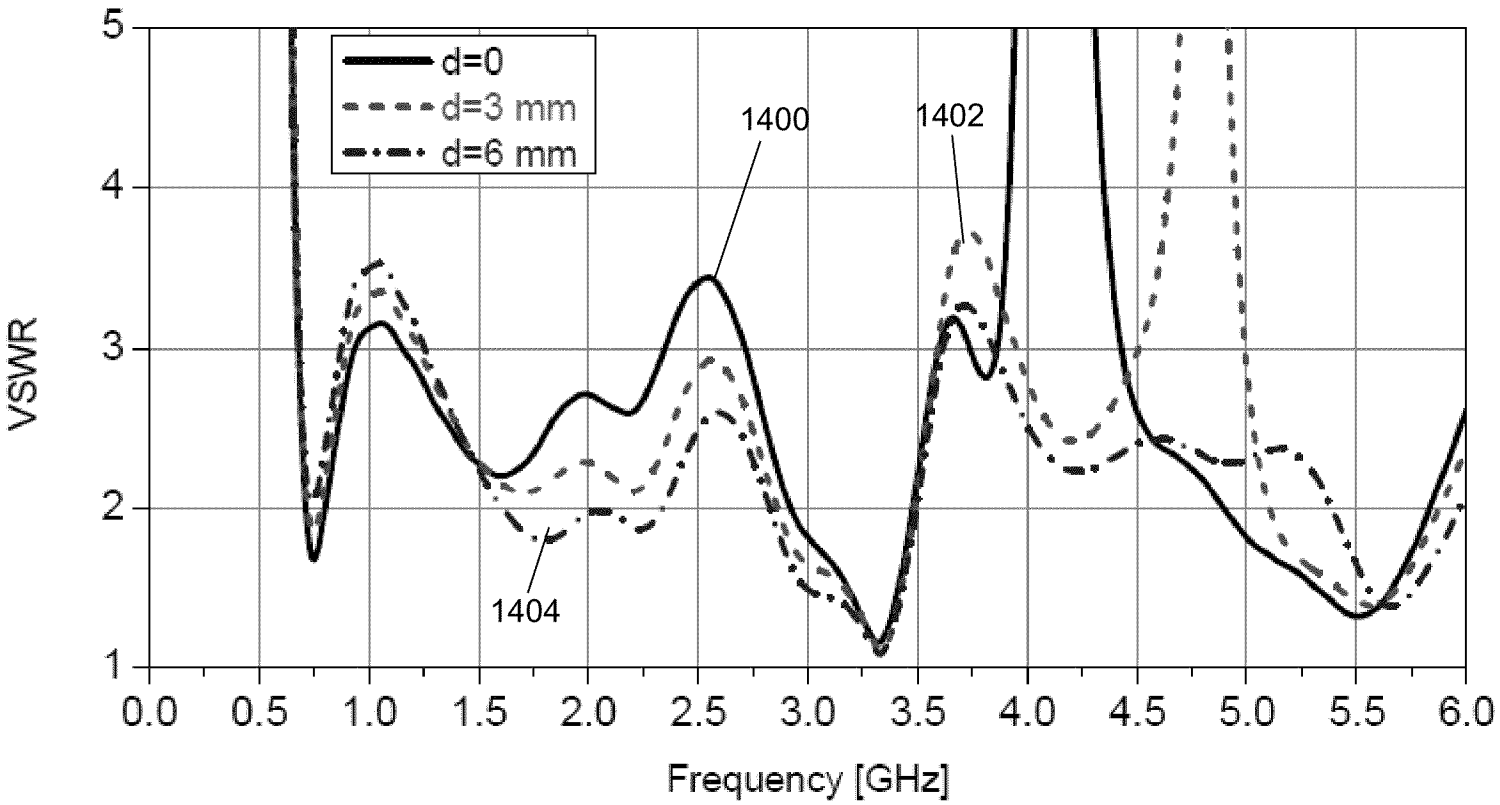
FIG. 14 is a graph showing a voltage standing wave ratio comparison between the bottom antennas of the antenna systems of FIGS. 1 and 6.
Figure 15:
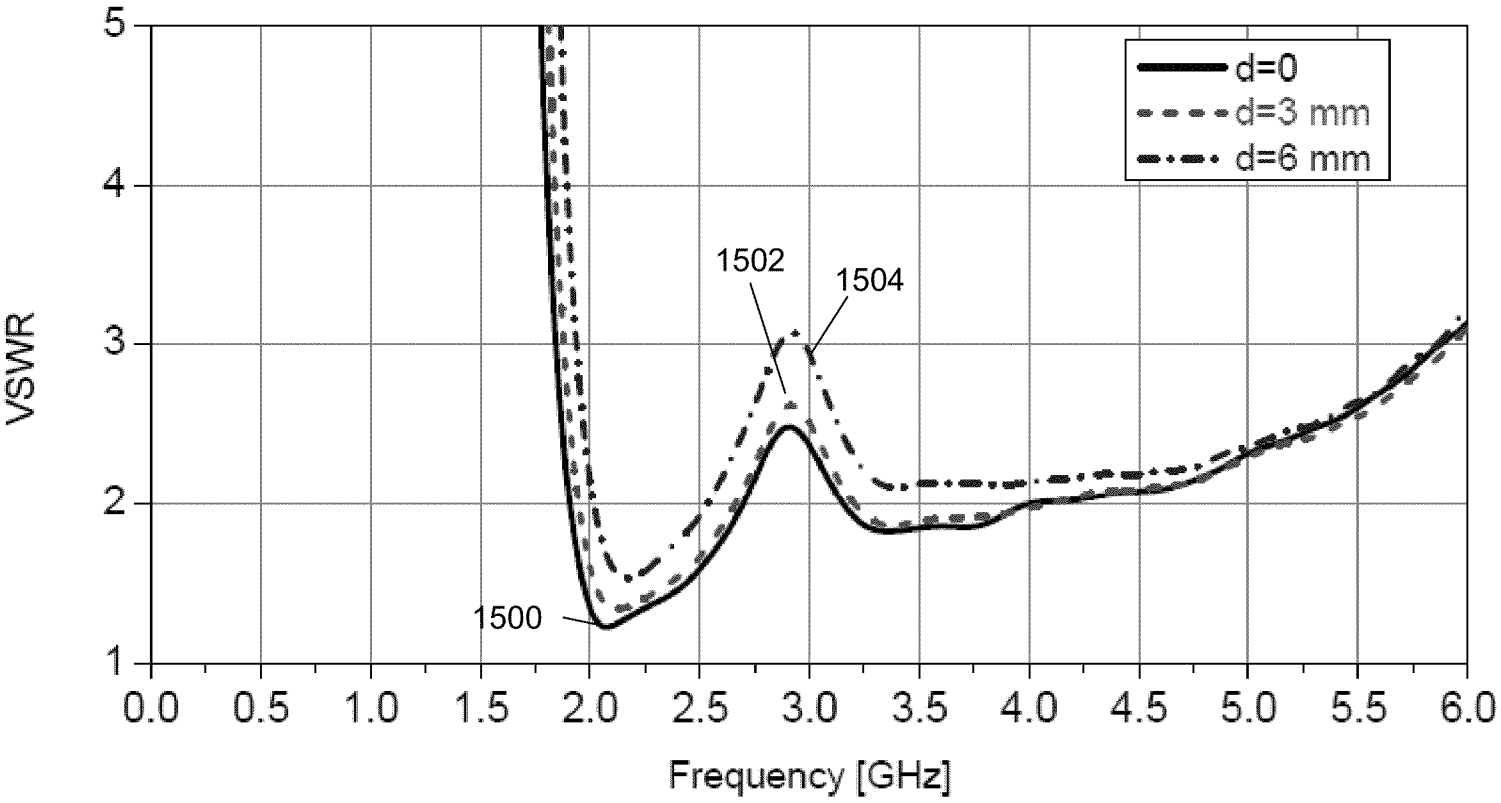
FIG. 15 is a graph showing a voltage standing wave ratio comparison between the top antennas of the antenna systems of FIGS. 1 and 6.

With reference to FIG. 14, a VSWR of first antenna 104/third antenna 104*a* for different values of recess depth 700, d, are shown. A first VSWR curve 1400 shows the VSWR for first antenna 104 (d=0). A second VSWR curve 1402 shows the VSWR for third antenna 104*a* with d=3 millimeters (mm). A third VSWR curve 1404 shows the VSWR for third antenna 104*a* with d=6 mm. With reference to FIG. 15, a VSWR of second antenna 106 for different values of d are shown. A fourth VSWR curve 1500 shows the VSWR for second antenna 106 with d=0. A fifth VSWR curve 1502 shows the VSWR for second antenna 106 with d=3 mm. A sixth VSWR curve 1504 shows the VSWR for second antenna 106 with d=6 mm.

As indicated in FIG. 14, changing recess depth 700 impacts the VSWR of first antenna 104/third antenna 104*a*. However, the most significant variations are observed at frequencies above 4 GHz, which fall outside the omni-directional bandwidth of first antenna 104/third antenna 104*a*. The cavity depth does not significantly impact the VSWR of first antenna 104/third antenna 104*a* below 4 GHz for d as large as 6 mm. As indicated in FIG. 15, increasing d slightly deteriorates the VSWR of second antenna 106, particularly in the frequency band of 2.5-3 GHz. Based on the results shown in FIGS. 14 and 15, choosing a cavity depth of d=6 mm offers a compromise between the overall height and impedance matching of second antenna system 100*a*.

Figure 16:
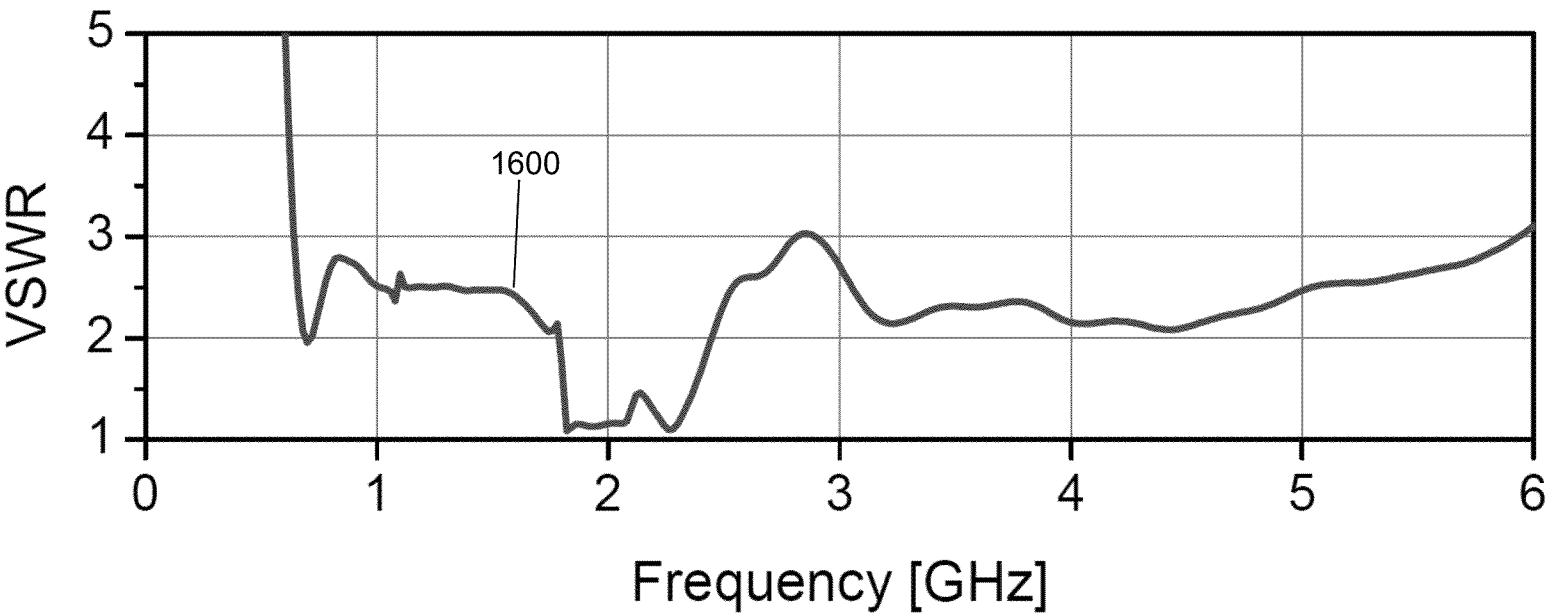
FIG. 16 is a graph showing a voltage standing wave ratio for the second antenna system of FIG. 6.

To predict the response of second antenna system 100*a* with feed network 900, second antenna system 100*a* was simulated in CST Microwave Studio® including the coaxial cable for feeding second antenna 106. With reference to FIG. 16, a simulated input VSWR curve 1600 of second antenna system 100*a* is shown as seen on feed line 912 of feed network 900. The response of third antenna 104*a* and second antenna 106 with d=6 mm can be combined successfully and is expected to have a VSWR below 3 from 0.64 to 6 GHz. Second antenna system 100*a* further has electrical dimensions of $0.24\lambda_{min}\times0.24\lambda_{min}\times0.04\lambda_{min}$, where $\lambda_{min}$ is a wavelength at a lowest operational frequency of second antenna system 100*a*.

Figure 17:
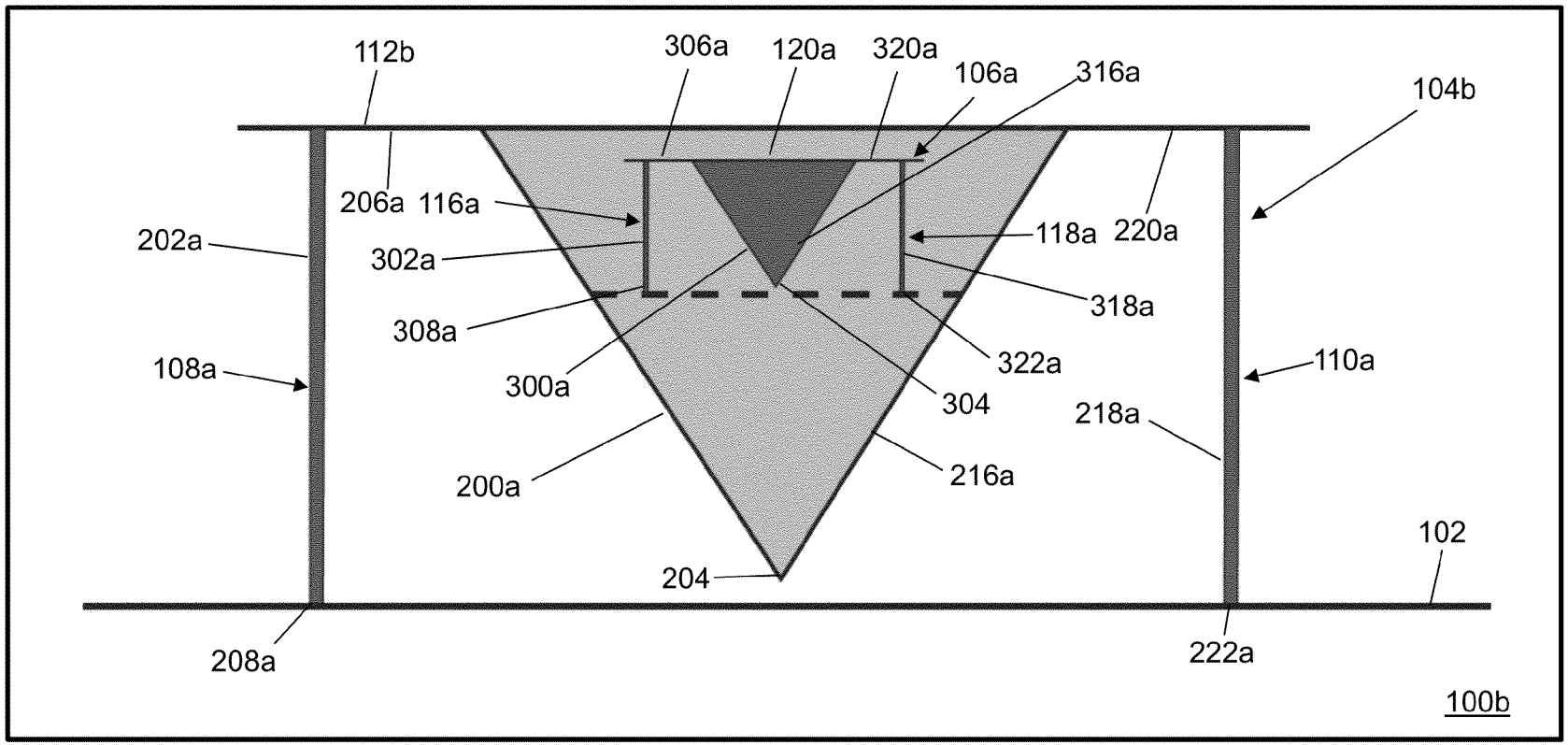
FIG. 17 shows a side view of a third antenna system in accordance with an illustrative embodiment.
Figure 18:
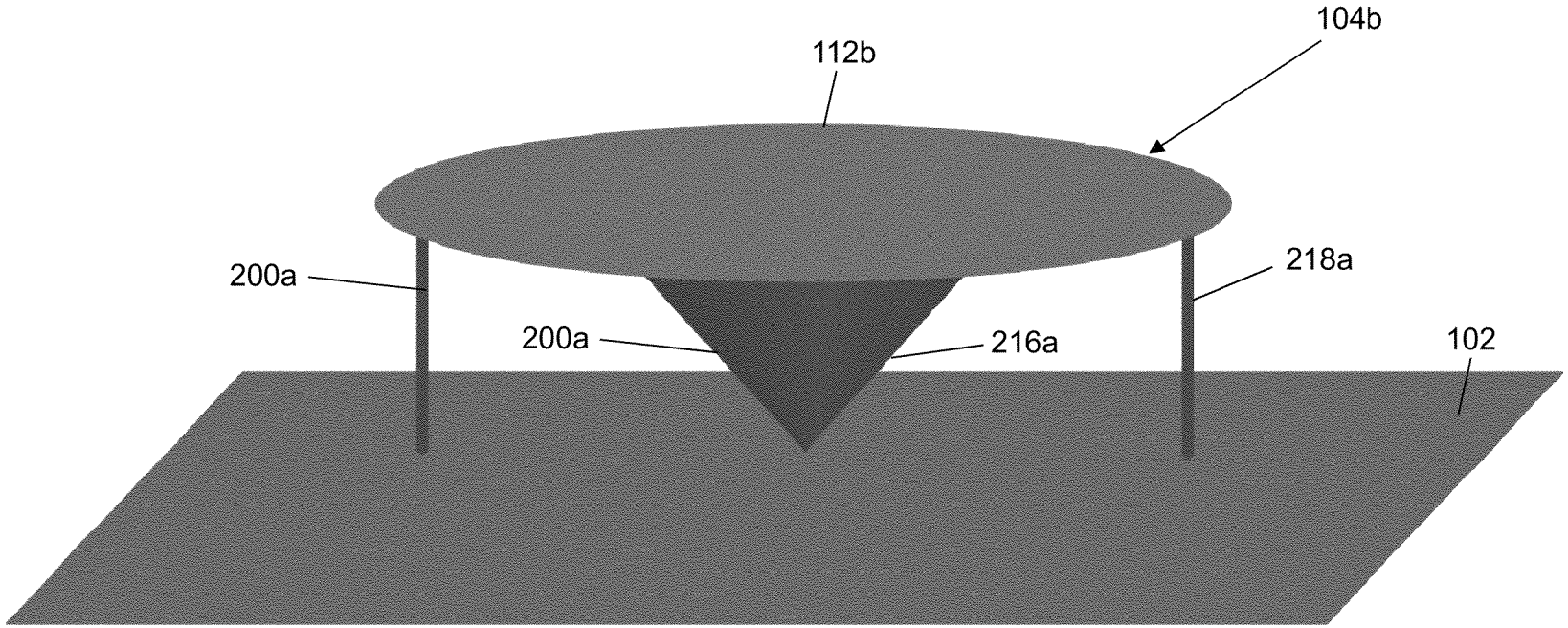
FIG. 18 shows a perspective view of a bottom antenna of the third antenna system of FIG. 17 with d=0 in accordance with an illustrative embodiment.

With reference to FIG. 17, a side view of a third antenna system 100*b* is shown in accordance with an illustrative embodiment. Third antenna system 100*b* may include ground plane substrate 102, a fourth antenna 104*b*, and a fifth antenna 106*a*. With reference to FIG. 18, a top perspective view of fourth antenna 104*b* with d=0 mounted on ground plane substrate 102 is shown in accordance with an illustrative embodiment.

Fourth antenna 104*b* may include a fifth loop conductor 108*a*, a sixth loop conductor 110*a*, and a fourth conductor 112*b*. Fifth loop conductor 108*a* is electrically connected to first feed point 204 and to ground plane substrate 102 at a sixth short circuit connection 208*a*. Fifth loop conductor 108*a* may include a first semi-circular conductor 200*a* and a first rod shaped conductor 202*a*. First semi-circular conductor 200*a* is electrically connected between first feed point 204 and fourth conductor 112*b*. First rod shaped conductor 202*a* is electrically connected between sixth short circuit connection 208*a* and fourth conductor 112*b*. A fifth edge 206*a* extends around a semi-circular edge of first semi-circular conductor 200*a* along fourth conductor 112*b* to a top edge of first rod shaped conductor 202*a* to provide the loop to ground.

Sixth loop conductor 110*a* is electrically connected to first feed point 204 and to ground plane substrate 102 at a seventh short circuit connection 222*a*. Sixth loop conductor 110*a* may include a second semi-circular conductor 216*a* and a second rod shaped conductor 218*a*. Second semi-circular conductor 216*a* is electrically connected between first feed point 204 and fourth conductor 112*b*. Second rod shaped conductor 218*a* is electrically connected between seventh short circuit connection 222*a* and fourth conductor 112*b*. A sixth edge 220*a* extends around a semi-circular edge of second semi-circular conductor 216*a* along fourth conductor 112*b* to a top edge of second rod shaped conductor 218*a* to provide the loop to ground. Fifth loop conductor 108*a* is mounted to ground plane substrate 102 as a mirror image of sixth loop conductor 110*a*.

Fifth antenna 106*a* may include a seventh loop conductor 116*a*, an eighth loop conductor 118*a*, and a fifth conductor 120*a*. Seventh loop conductor 116*a* is electrically connected to second feed point 304 and to fourth conductor 112*b* at an eighth short circuit connection 308*a*. Seventh loop conductor 116*a* may include a third semi-circular conductor 300*a* and a third rod shaped conductor 302*a*. Third semi-circular conductor 300*a* is electrically connected between second feed point 304 and fifth conductor 120*a*. Third rod shaped conductor 302*a* is electrically connected between eighth short circuit connection 308*a* and fifth conductor 120*a*. A seventh edge 306*a* extends around a semi-circular edge of third semi-circular conductor 300*a* along fifth conductor 120*a* to a top edge of third rod shaped conductor 302*a* to provide the loop to ground.

Eighth loop conductor 118*a* is electrically connected to second feed point 304 and to fourth conductor 112*b* at a ninth short circuit connection 322*a*. Eighth loop conductor 118*a* may include a fourth semi-circular conductor 316*a* and a fourth rod shaped conductor 318*a*. Fourth semi-circular conductor 316*a* is electrically connected between second feed point 304 and fifth conductor 120*a*. Fourth rod shaped conductor 318*a* is electrically connected between ninth short circuit connection 322*a* and fifth conductor 120*a*. An eighth edge 320*a* extends around a semi-circular edge of fourth semi-circular conductor 316*a* along fifth conductor 120*a* to a top edge of fourth rod shaped conductor 318*a* to provide the loop to ground. Seventh loop conductor 116*a* is mounted to fifth conductor 120*a* as a mirror image of eighth loop conductor 118*a*.

In the illustrative embodiment of FIGS. 17 and 18, first semi-circular conductor 200*a*, second semi-circular conductor 216*a*, third semi-circular conductor 300*a*, and fourth semi-circular conductor 316*a* form a cone, and fifth conductor 120*a* has a circular shape when projected into the plane defined by ground plane substrate 102. Other shapes may be used.

First rod shaped conductor 202*a* and second rod shaped conductor 218*a* form a right angle at the connection point with ground plane substrate 102 though first rod shaped conductor 202*a* and second rod shaped conductor 218*a* may be positioned closer to or further from first feed point 204 to form an angle that is less than ±90°. Third rod shaped conductor 302*a* and fourth rod shaped conductor 318*a* form a right angle at the connection point with fourth conductor 112*b* though third rod shaped conductor 302*a* and fourth rod shaped conductor 318*a* may be positioned closer to or further from second feed point 304 to form an angle that is less than ±90°. First rod shaped conductor 202*a*, second rod shaped conductor 218*a*, third rod shaped conductor 302*a*, and fourth rod shaped conductor 318*a* further may have other cross sectional shapes such as elliptical or polygonal. First rod shaped conductor 202*a* and second rod shaped conductor 218*a* further may be mounted to fourth conductor 112*b* closer to of further from first semi-circular conductor 200*a* and second semi-circular conductor 216*a*, respectively. Third rod shaped conductor 302*a* and fourth rod shaped conductor 318*a* further may be mounted to fifth conductor 120*a* closer to or further from third semi-circular conductor 300*a* and fourth semi-circular conductor 316*a*, respectively.

Though not shown in FIGS. 17 and 18, first feed point 204 and second feed point 304 connect to first feed connector 114 and second feed connector 122, respectively, as discussed with reference to antenna system 100. First feed connector 114 and second feed connector 122 of third antenna system 100*b* may be connected to feed network 900.

Fourth antenna 104*b* and fifth antenna 106*a* may be formed of any conducting material(s) suitable for forming a radiator of third antenna system 100*b*. For example, fourth antenna 104*b* and fifth antenna 106*a* may be formed of copper or brass sheets among many other options as understood by a person of skill in the art. Fifth loop conductor 108*a*, sixth loop conductor 110*a*, fourth conductor 112*b*, seventh loop conductor 116*a*, eighth loop conductor 118*a*, and fifth conductor 120*a* may be formed of the same or different materials.

The word "illustrative" is used herein to mean serving as an illustrative, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, for the purposes of the description, the use of "and" or "or" is intended to include "and/or" unless specifically indicated to only include "and" or "or". Use of directional terms, such as top, bottom, right, left, front, back, upper, lower, above, below, etc. are merely intended to facilitate reference to the various surfaces of the described structures relative to the orientations shown in the drawings and are not intended to be limiting in any manner.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. An antenna system comprising:
- a ground plane substrate that is generally flat;
- a first antenna comprising
  - a first loop conductor electrically connected at a first point to a feed network and at a second point to the ground plane substrate;
  - a second loop conductor electrically connected at a third point to the feed network and at a fourth point to the ground plane substrate; and
  - a first conductor mounted to and electrically connected to a first edge of the first loop conductor between the first point and the second point and to a second edge of the second loop conductor between the third point and the fourth point; and
- a second antenna comprising
  - a third loop conductor electrically connected at a fifth point to the feed network and at a sixth point to the first conductor;
  - a fourth loop conductor electrically connected at a seventh point to the feed network and at an eighth point to the first conductor; and
  - a second conductor mounted to and electrically connected to a third edge of the third loop conductor between the fifth point and the sixth point and to a fourth edge of the fourth loop conductor between the seventh point and the eighth point.

2. The antenna system of claim 1, wherein the second conductor is generally flat and oriented in a first plane approximately parallel to a second plane defined by the ground plane substrate.

3. The antenna system of claim 2, wherein the first conductor is generally flat and oriented in a third plane approximately parallel to the first plane and to the second plane.

4. The antenna system of claim 2, wherein the second conductor has a polygonal shape when projected into the second plane.

5. The antenna system of claim 2, wherein the first conductor is generally flat and oriented in a third plane approximately parallel to the first plane and to the second plane except for a recess formed by a first wall that extends from the first edge downward toward the first point and a second wall that extends from the second edge downward toward the third point.

6. The antenna system of claim 1, further comprising the feed network, wherein the feed network comprises a diplexer configured to provide a first signal having a transmission frequency below approximately a first frequency to the first antenna and to provide a second signal having a transmission frequency approximately above the first frequency to the second antenna.

7. The antenna system of claim 6, wherein the feed network further comprises an impedance matching circuit electrically connected to the diplexer.

8. The antenna system of claim 7, wherein the impedance matching circuit comprises a series connected capacitor connected between the diplexer and the first antenna.

9. The antenna system of claim 6, wherein the second antenna is a smaller scaled version of the first antenna, wherein the second antenna is scaled in size relative to the first antenna based on the first frequency.

10. The antenna system of claim 1, further comprising a third antenna comprising:

a fifth loop conductor electrically connected at a ninth point to the feed network and at a tenth point to the second conductor;

a sixth loop conductor electrically connected at an eleventh point to the feed network and at a twelfth point to the second conductor; and a third conductor mounted to and electrically connected to a fifth edge of the fifth loop conductor between the ninth point and the tenth point and to a sixth edge of the sixth loop conductor between the eleventh point and the twelfth point.

11. The antenna system of claim 1, wherein the first antenna further comprises a fifth loop conductor electrically connected at a ninth point to the feed network, at a tenth point to the ground plane substrate, and along a fifth edge to the first conductor.

12. The antenna system of claim 1, wherein the sixth point and the eighth point are between the first edge and the second edge.

13. The antenna system of claim 12, wherein a minimum distance between the sixth point and the ground plane substrate is less than a minimum distance between the first edge and the ground plane substrate.

14. The antenna system of claim 12, wherein the first conductor extends from the first edge generally parallel to the ground plane substrate away from the second antenna, wherein the first conductor extends from the second edge generally parallel to the ground plane substrate away from the second antenna, wherein the first conductor extends from the first edge downward toward the first point and along the first loop conductor to define a fifth edge, wherein the first conductor extends from the second edge downward toward the third point and along the second loop conductor to define a sixth edge, and wherein the first conductor extends generally parallel to the ground plane substrate between the fifth edge and the sixth edge.

15. The antenna system of claim 1, wherein the first point and the third point are between the first edge and the second edge.

16. The antenna system of claim 1, wherein the second loop conductor is mounted as a mirror image of the first loop conductor.

17. The antenna system of claim 16, wherein the first loop conductor has a quadrilateral shape when projected into a plane defined by the ground plane substrate, wherein a first pair of adjacent sides of the quadrilateral shape that extend from the first point are of equal length and a second pair of adjacent sides of the quadrilateral shape that extend from the second point are of equal length.

18. The antenna system of claim 17, wherein the first edge extends along a diagonal that connects the first pair of adjacent sides and the second pair of adjacent sides.

19. The antenna system of claim 16, wherein the first loop conductor is connected to the ground plane substrate at only the second point.

20. The antenna system of claim 16, wherein the first loop conductor comprises a half-cone conductor and a rod conductor, wherein the half-cone conductor is electrically connected at the first point to the feed network and at a ninth point to the first conductor, wherein the rod conductor is electrically connected at the second point to the ground plane substrate and at a tenth point to the first conductor.

* * * * *